US005161797A

United States Patent [19]

Frasca

[11] Patent Number: 5,161,797

[45] Date of Patent: Nov. 10, 1992

[54] OUTDOOR BILLIARDS TABLE

[75] Inventor: Dino A. Frasca, Woodbridge, Canada

[73] Assignee: Comus International Leisure Products Inc., Maple, Canada

[21] Appl. No.: 739,414

[22] Filed: Aug. 2, 1991

[51] Int. Cl.[5] ..... A63D 15/00

[52] U.S. Cl. ..... 273/3 R

[58] Field of Search ..... 273/2, 3 R, 3 C, 6

[56] References Cited

U.S. PATENT DOCUMENTS

| | | | |
|---|---|---|---|
| 1,259,951 | 3/1918 | Adams | 273/6 |
| 1,534,711 | 4/1925 | Hoskin | 273/6 |
| 1,950,221 | 3/1934 | Buckler | 273/3 R |
| 2,100,981 | 11/1937 | Seifert | 273/6 |
| 3,263,996 | 8/1966 | Braun | 273/6 X |
| 3,876,202 | 4/1975 | Allison | 273/3 C |

*Primary Examiner*—William H. Grieb

*Attorney, Agent, or Firm*—Ridout & Maybee

[57] ABSTRACT

An outdoor billiards table comprises supporting legs, a supporting frame, a playing surface and side and end rails formed from concrete. Main levellers are disposed between the supporting frame and the supporting legs to level the table, and slate levellers are provided along sections of the playing surface for levelling and to compensate for warpage. The playing surface is composed of a mixture of non-shrink construction grout containing graded siliceous aggregate, water reducing agents and fluidizing agents, portland cement and synthetic fibres, and is cast on plexiglass for a glass-smooth finish.

15 Claims, 6 Drawing Sheets

OUTDOOR BILLIARDS TABLE

FIELD OF THE INVENTION

This invention relates to billiards tables. In particular, this invention relates to a billiards table designed for outdoor use.

BACKGROUND OF THE INVENTION

Billiards is a popular game worldwide. Many different styles and designs of billiards tables have been developed, typically in the standard sizes of 4 foot×8 foot, 4½ foot×9½ foot, 5 foot×10 foot and 6 foot×12 foot. Typically such a billiards table comprises a wooden frame and support legs supporting a one- or three-piece slate playing surface covered with felt and surrounded by rails having a resilient inner edge to facilitate rebounding of the billiards balls in play. However, such billiards tables are useful only for indoor play, since the wood components are not able to withstand climatic conditions such as rain or extreme humidity, heat or cold, and parasitic infestation.

The present invention provides a billiards table designed for both indoor and outdoor use. Virtually all components of the billiards table of the subject invention are cast in concrete or milled from natural stone, preferably concrete, and are thus able to withstand severe climatic conditions and are impervious to parasitic infestation.

The use of concrete or other cast or natural stones for this purpose presents unique problems. Many of the components, when formed of stone or concrete, are too fragile to be bolted to other components in a conventional manner without cracking or breaking, and tolerances must be exact. The felt cannot be stapled to the playing surface in a conventional fashion, since staples will not penetrate concrete or stone, yet it must be secured so as to prevent shifting and stretching while at the same time permitting replacement with relative ease. Particularly for outdoor use on soft surfaces such as grass, levellers typically disposed at the foot of the supporting legs are ineffectual, yet on such a surface precise levelling is important because the supporting structure will tend to sink into the ground unevenly, and rises and settles unevenly over the freeze-thaw cycle in colder climates. The playing surface itself must be resistant to extreme climatic conditions, and particularly to warping and shrinking under such conditions.

The subject invention overcomes these disadvantages by providing a billiards table in which, in a preferred embodiment, the components are virtually all composed of concrete, yet assemble to provide a billiards table which provides the same quality of play as conventional wood frame tables. Angle irons and plate assemblies embedded in the more delicate components affix such components to the frame and playing surface. Attachment of the felt is accomplished through the use of retaining strips embedded in slots moulded or cut into the rails. Levellers are provided at the tops of the supporting legs so that the frame may be easily levelled. The playing surface is composed of a specially designed concrete/grout mix resistant to warpage, shrinking and cracking, and is affixed to the frame through a series of levelling bolts to prevent and compensate for warping.

These and other advantages of the invention will be apparent from the detailed description set out below.

SUMMARY OF THE INVENTION

The present invention thus provides a billiards table comprising a frame supported on supporting legs, a playing surface supported on the frame, and side and end rails affixed to the playing surface, wherein the supporting legs, frame and rails are composed of concrete or natural stone.

The present invention further provides a playing surface for a billiards table, composed of a mixture of non-shrink construction grout, portland cement, graded siliceous aggregate and synthetic fibre strands.

The present invention further provides a method of casting a playing surface for a billiards table, including the steps of mixing a suitable quantity of a mixture of construction grout and portland cement, blending into the mixture synthetic fibre strands, and casting the mixture into a form comprising a plexiglass bottom panel.

BRIEF DESCRIPTION OF THE DRAWINGS

In drawings which illustrate by way of example only a preferred embodiment of the subject invention.

DETAILED DESCRIPTION OF THE INVENTION

Figure 1:
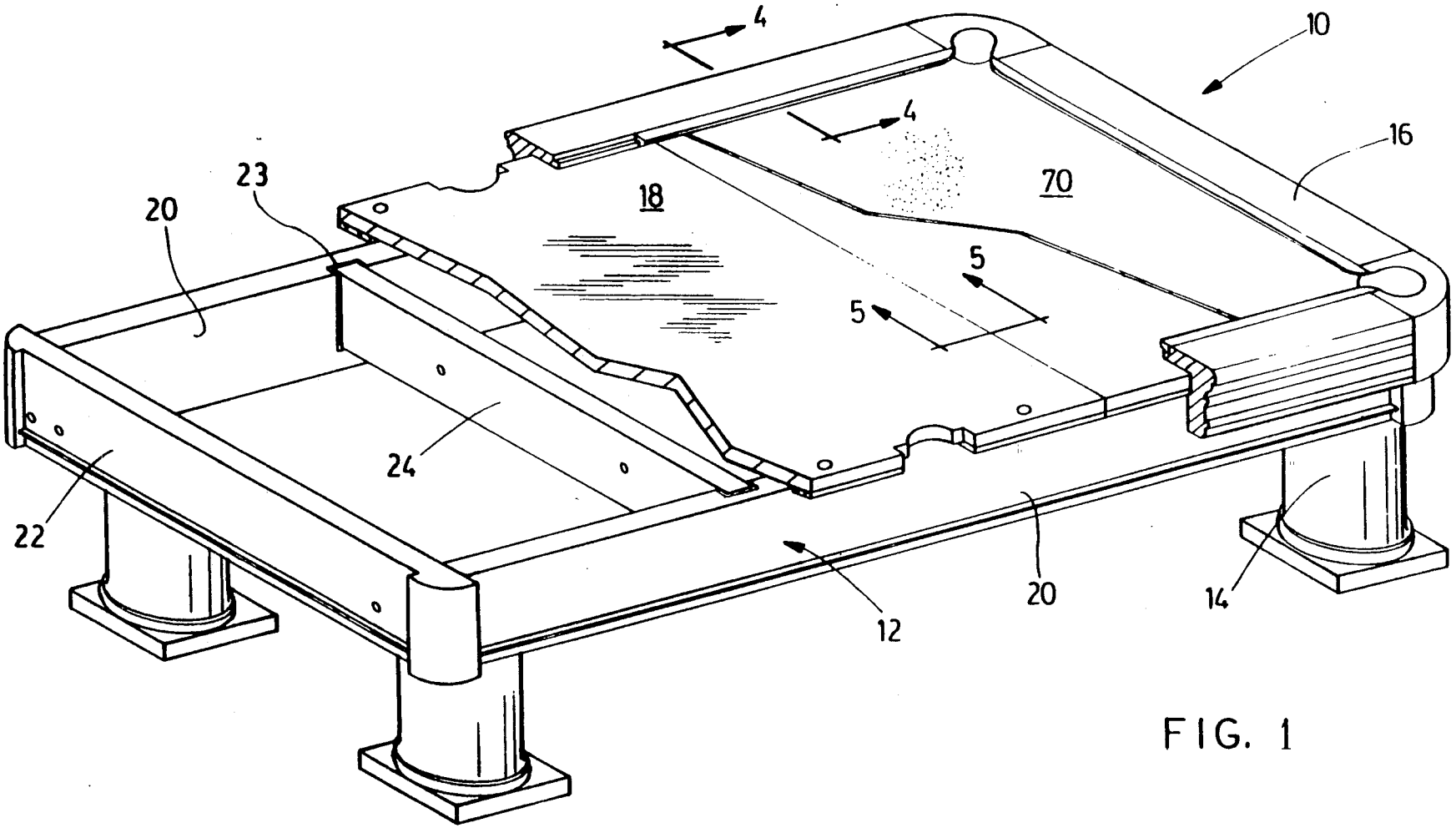
FIG. 1 is a partially cut away perspective view of a billiards table embodying the subject invention.
Figure 2:
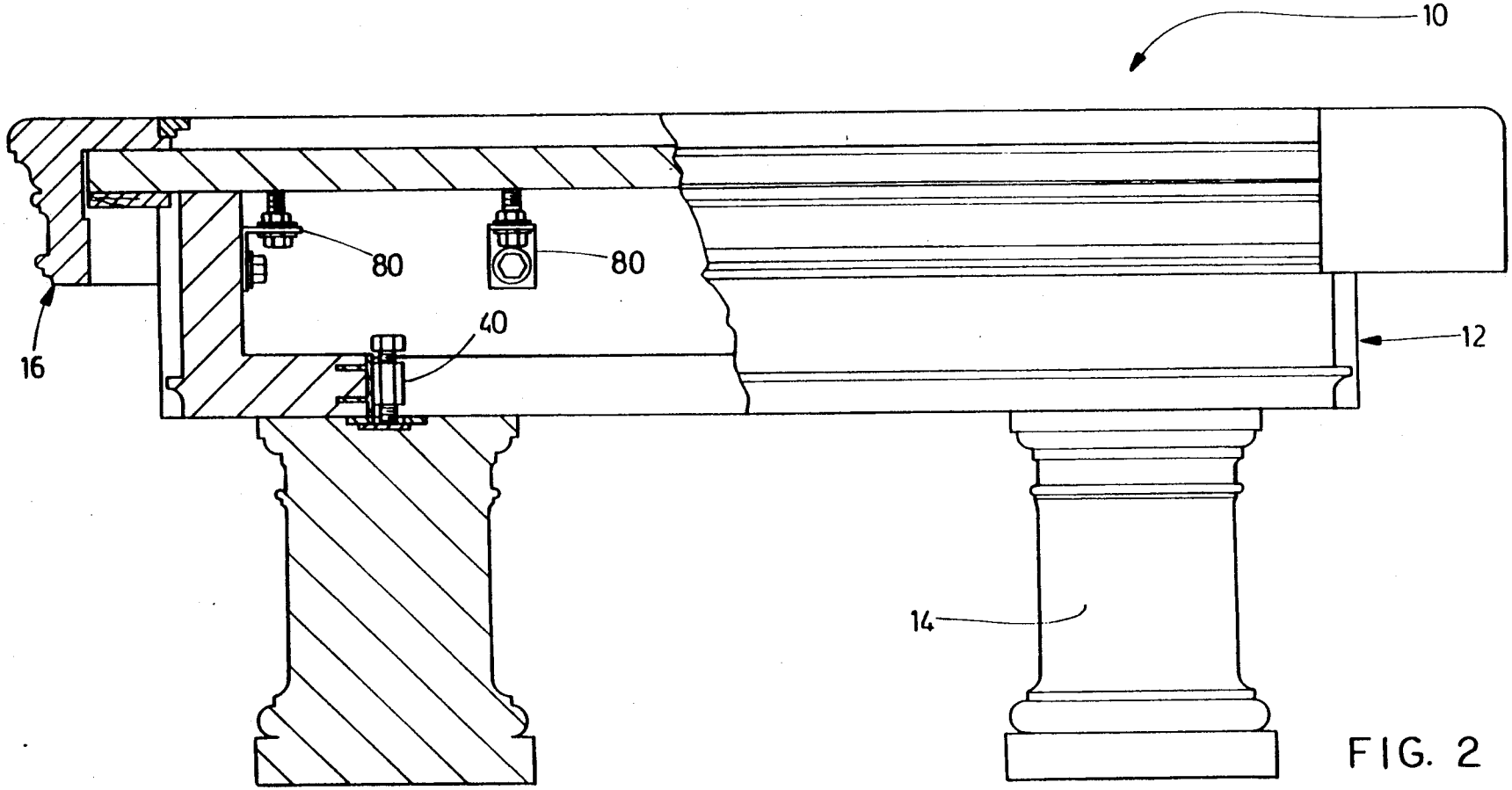
FIG. 2 is a partially sectional elevation illustrating the billiards table of FIG. 1.

In a preferred embodiment of the billiards table 10 of the subject invention, the frame 12, supporting legs 14 and rails 16 are composed of cast concrete. These components may be formed from any type of cast stone, or milled from natural stone, in accordance with conventional techniques. The following description refers to a preferred embodiment, utilizing cast concrete, however unless otherwise indicated the description is intended to include all suitable types of cast and natural stone.

All concrete components except for the playing surface 18 (the composition of which is described below) are preferably cast using a mix of concrete comprising 0.352 parts high early portland cement, one part concrete or brick sand, one part ⅜ inched crushed washed limestone, 0.00025 parts air entraining agent and 0.002 parts of a water reducing agent such as POZZOLITH 122HE (trade-mark). Tolerances must be exact in order to prevent cracking or breakage of the components during assembly. Reinforcing bar may be employed in a conventional fashion, but should not be necessary (except where indicated) if the components are cast to the specifications indicated. Connections are made utilizing, unless otherwise indicated, ½ inch bolts extending through ¾ inch (interior diameter) pipe sleeves to ½ inch inserts. The pipe sleeves and inserts are embedded in the components during casting. For natural stone, conventional drilling may be employed. Abutting concrete components are cushioned by a thin layer (about ⅛ inch)

of high density foam to prevent cracking and chipping when bolts are tightened.

Figure 3:
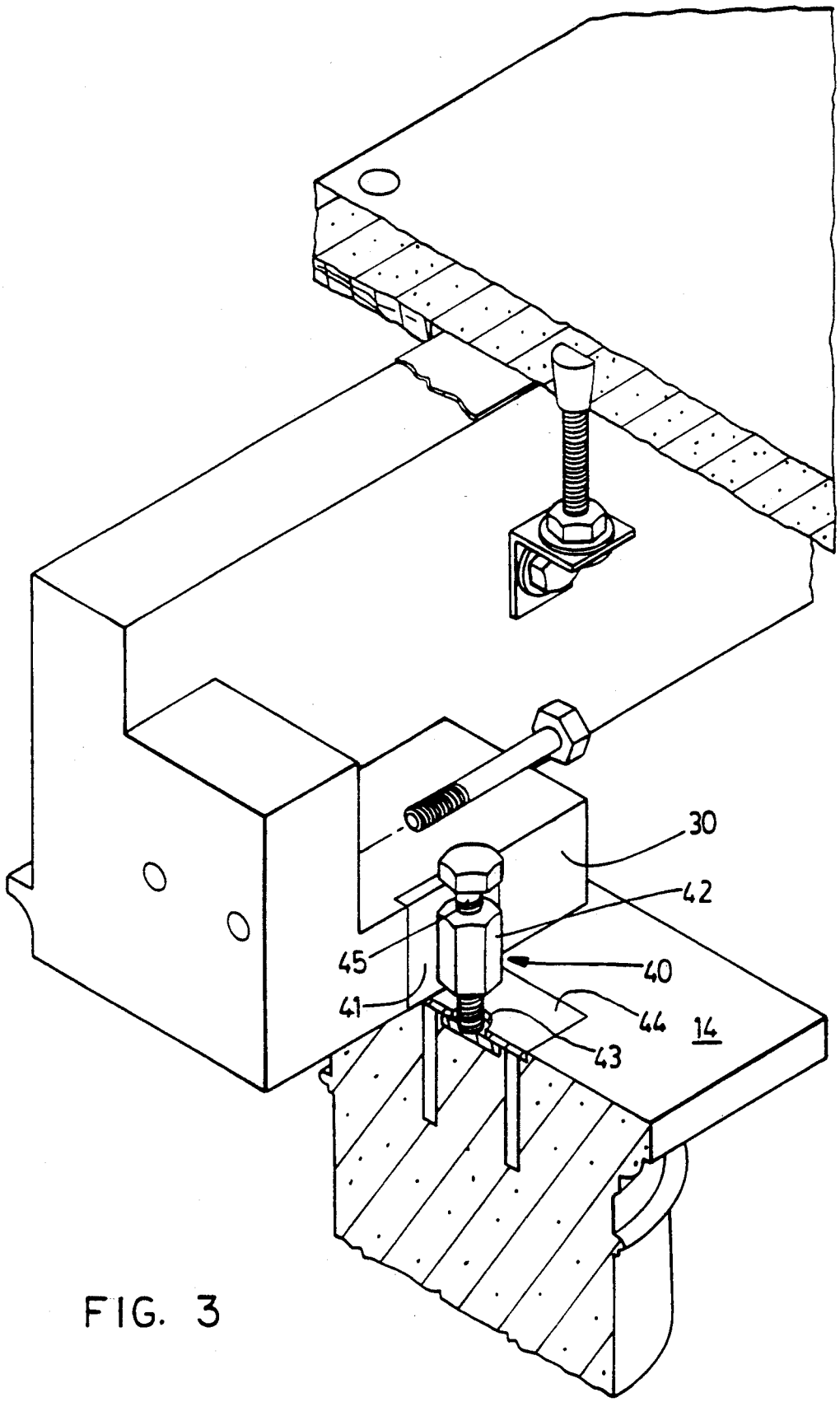
FIG. 3 is a partially sectional perspective view illustrating means for levelling the frame of the billiards table.

Referring to FIG. 1, a frame 12 comprises a pair of side supports 20, a pair of end supports 22 and a pair of centre supports 24, each approximately three inches in thickness and ten inches high, and of a length suitable for the size of billiards table desired bearing in mind that the playing surface 18 should overhang the frame 12 by approximately 4 ¼ inches on each side. The end supports 22 are affixed to the side supports 20 through haunches 30 cast integrally on each end of the side supports 20, as illustrated in FIG. 3. The haunches 30 are supported on main levellers 40, described in greater detail below.

The centre supports 24 preferably divide the frame 12 into three generally congruent sections. The centre supports 24 preferably nest in recesses 23 formed in the side supports 20. Pipe sleeves are cast into the centre supports, as shown in FIG. 1, for attachment of slate levellers 80, described below.

The frame is supported on main levellers 40 embedded in each of the haunches 30. Each leveller 40, illustrated in FIG. 3, preferably comprises a plate 41 embedded in the haunch 30 having a coupling nut 42 welded thereto. A bolt 45 extends through the nut 42 with the end of the bolt 45 seated in a countersunk recess 43 in a plate 44 cast into the top of the supporting leg 14. Each corner of the frame 12 is thus adjusted vertically by turning the bolt 45. The supporting legs 14 are preferably at least ten inches in diameter to properly support the table 10.

The playing surface or "slate" 18 is preferably formed from three 2 inch thick panels cast from a concrete/grout mix comprising a premixed non-shrink construction grout admixture such as that manufactured by Construction Product Distribution Services of Concord, Ontario, Canada and marketed under the name CPD Grout Admixture, containing non-ferrous fluidifying agents, water reducing agents and anti-shrinkage compounds formulated to comply with U.S. Corps of Engineers specifications for grout fluidifiers CRD-C-566. The grout admixture is mixed with graded siliceous aggregate and portland cement, and blended with a suitable amount of water and FIBERMESH (trademark) a fibrous concrete additive comprising synthetic fibre strands marketed by Fibermesh Company of Chickamauga, Georgia, to prevent cracking. Preferably one part of FIBERMESH is blended with 700 parts of grout/cement mixture. The slate panels are cast on plexiglass for a glass-smooth finish on the playing side. This particular mixture has been found to be extremely resistant to chipping and cracking, and will provide at least as satisfactory a playing surface as true slate while being less subject to warpage. Suitable accommodation is made for the pockets 74, anchors for the slate levellers 80 (described below), and orifices for receiving bolts cast in the rails 16.

Figure 5:
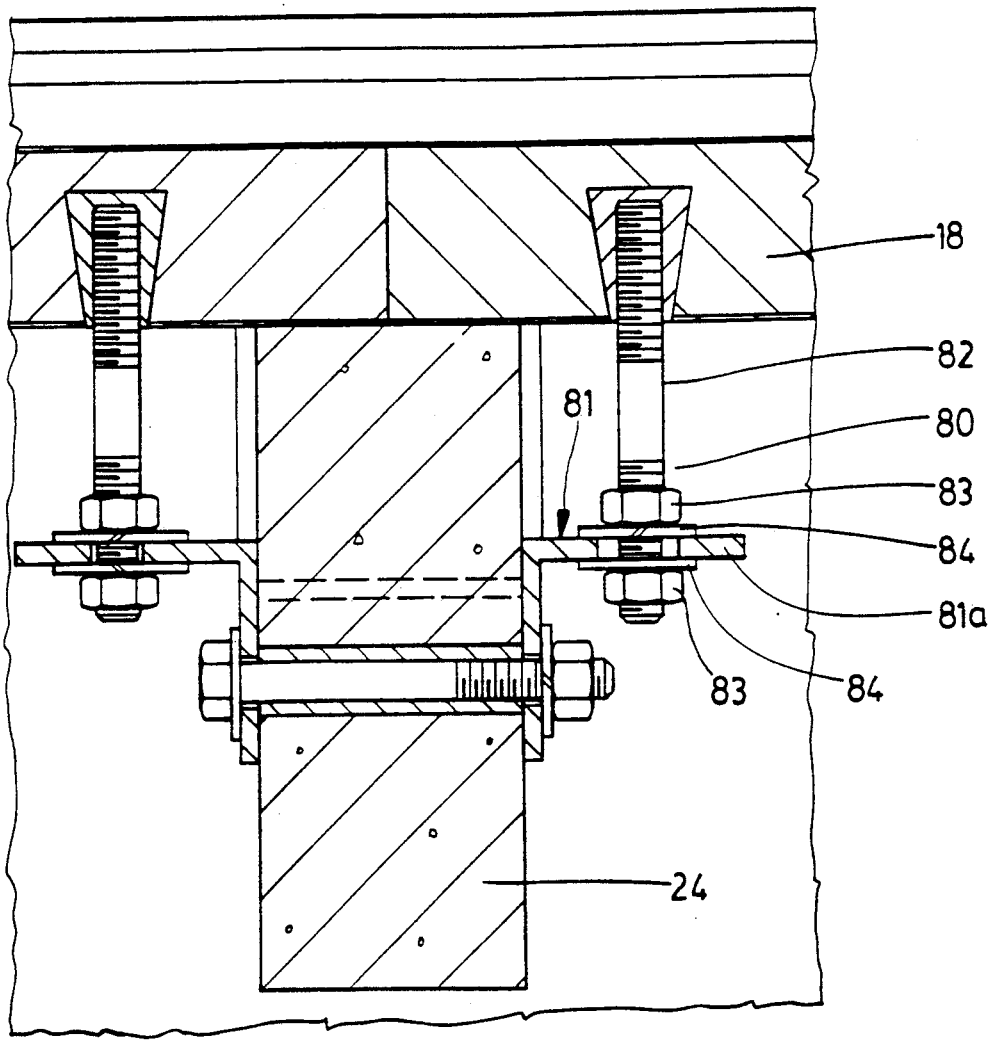
FIG. 5 is a cross-section illustrating means for levelling the playing surface.

Each section of the slate 18 is supported on the frame 12 by a series of slate levellers 80, illustrated in FIG. 5, preferably two evenly spaced along the end of each panel and one centred along the side of each panel. The slate levellers 80 comprise a corner bracket 81 bolted to the interior of the frame 12 having an arm **81*a* extending parallel to the slate 18. A threaded rod 82 embedded in the slate 18 extends through the parallel arm 81*a* of the corner bracket 81, and a pair of nuts 83 and washers 84 is provided for adjusting the level of the slate panel and locking the threaded rod 82 in place once the desired level has been reached. Thus abutting panels can be adjusted to be level and to join evenly. Moreover, since the slate 18 is slightly flexible, deformations in the contour of the slate 18 which appear over time can be compensated for by readjusting the slate levellers 80**.

Figure 4:
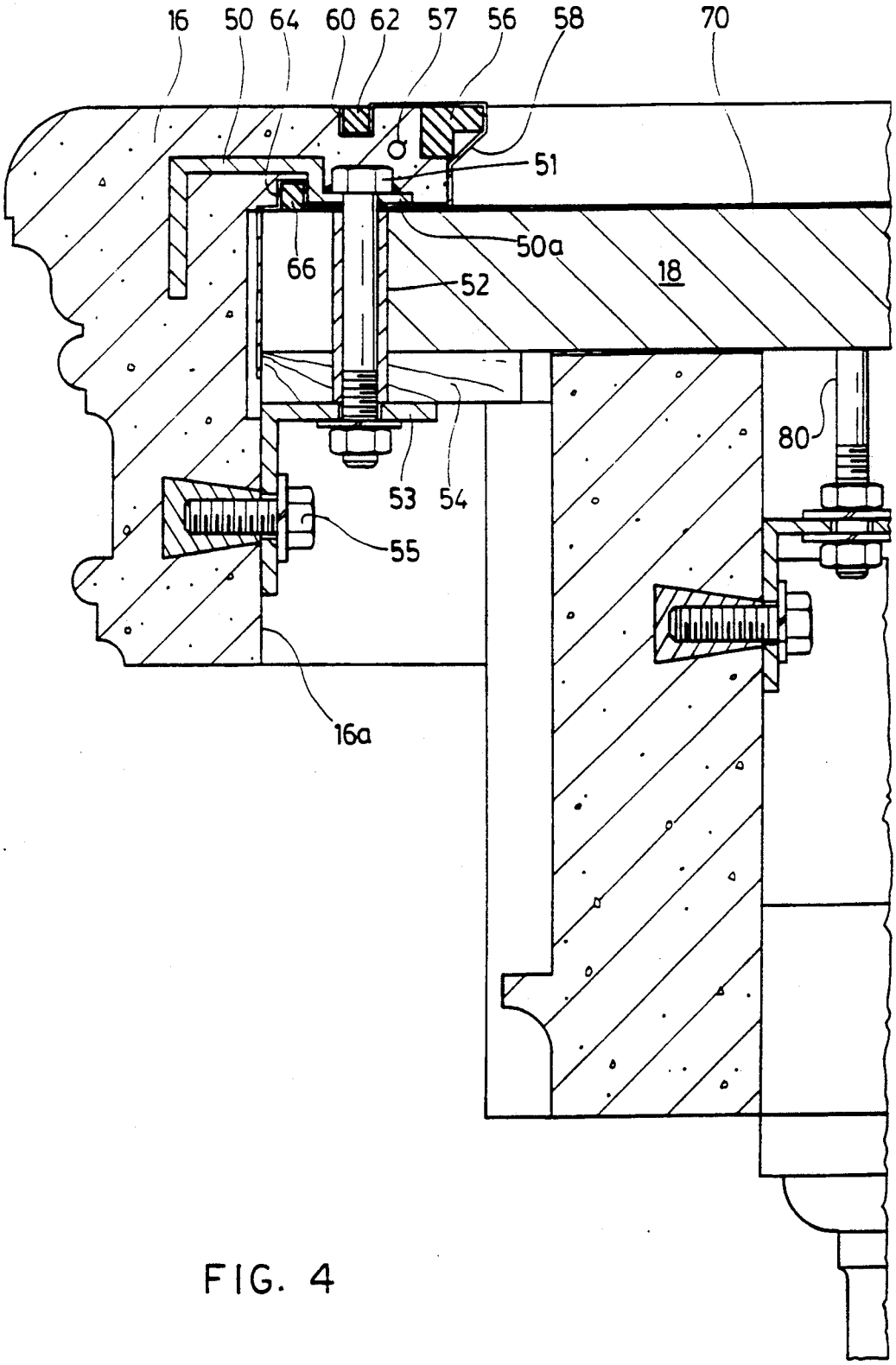
FIG. 4 is a cross-section illustrating the manner of attachment of the rails to the playing surface.
Figure 6:
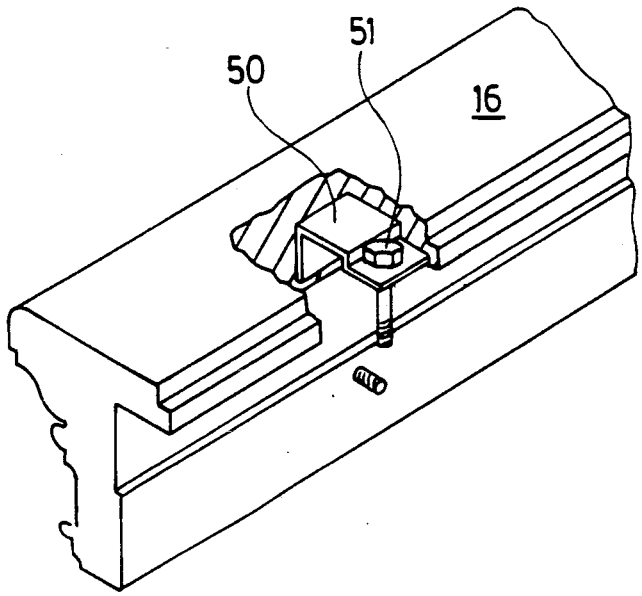
FIG. 6 is a partly cut away perspective view of a rail.

The side and end rails 16, illustrated in FIGS. 4 and 6, are cast with a retaining bracket 50 and bolt 51 at even intervals along each rail 16. A corresponding pipe sleeve 52 is cast in the slate 18, and the bolt 51 extends through the sleeve 52 and through an arm of a corner bracket 53 bolted to an interior vertical portion **16*a* of the rail 16. A strip 54 of pressure treated or other weather resistant wood, extending substantially the length of each edge of the playing surface 18, is interposed between the slate 18 and the arm of the corner bracket 53, for attachment of the felt 70 as described below. By removing the corner brackets 53, the rails 16 may be removed for attachment or replacement of the felt 58, 70**.

Each rail 16 includes a rubber or other resilient bumper 56 glued to or formed in the rail 16 and extending above the edge of the playing surface 18. Preferably reinforcing bar 57 is embedded in the rail 16 adjacent to the rubber bumper 56, to reinforce against the repeated shock of billiards balls rebounding during play.

Figure 7:
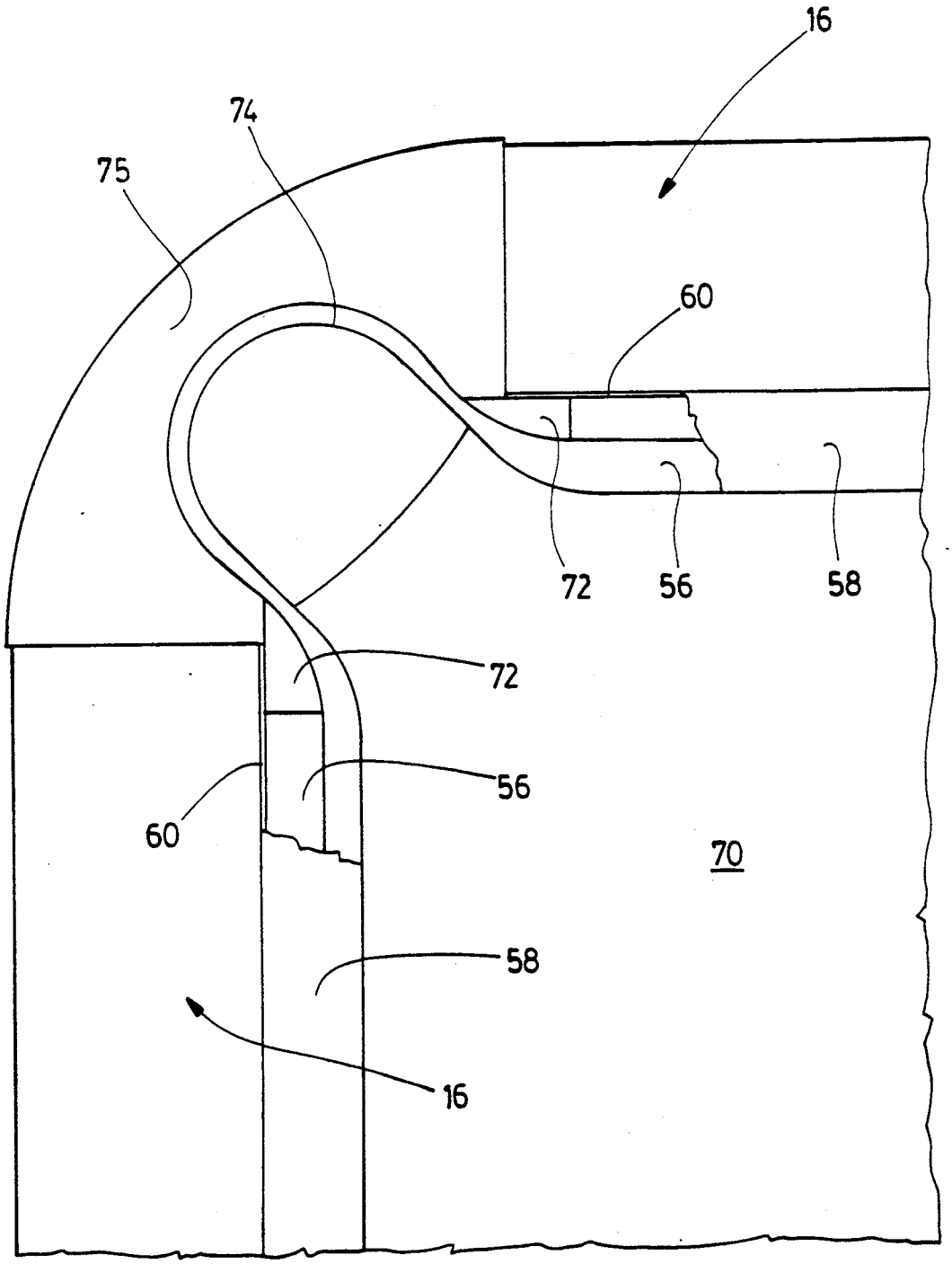
FIG. 7 is a partly cutaway top plan view illustrating a corner pocket and rail ends.

A block 72 of weather resistant wood is attached with epoxy to each end of the playing surface of each rail 16, to provide a suitable curvature at the entrance to each pocket 74, as shown in FIG. 7. Wood is preferably used in this case because the end piece tapers to a dimension which is too slender to be formed from concrete or natural stone, and the curvature must be very precise. The wood block 72 also provides a surface to which the felt can be stapled in the region of the rail 16 near the pockets 74, which is a particularly difficult place to stretch the felt 58 evenly. The rubber bumper 56 extends and tapers into the tapered end of each wood block 72.

Felt is applied around the rail 16 prior to attachment. One edge of the felt 58 is retained in an upper rail slot 60 by a retaining strip 62 comprised of weather resistant wood, or rubber or plastic or another material adapted to snugly nest in the slot 60. The felt 58 is stretched taut around the playing surface of the rail 16 and retained in a lower rail slot 64 by a retaining strip 66. Staples are applied as necessary to smooth the felt 58 in the region of the wood block 72. An edge of a felt panel 70 for the playing surface is drawn over the edge of the table, down to the wood strip 54, folded at the edge and stapled taut prior to attaching the rails 16.

Concrete corner pieces 75 are bolted to adjacent ends of the rails 16 using ¼ inch × 1½ inch countersunk screws into anchors embedded in the rails 16, and the screw heads are preferably capped with plastic plugs. The pocket sleeve 74 sits in the corner piece 75 as shown in FIG. 7. The side pockets are similarly constructed.

Having thus described by way of example the preferred embodiment of the subject invention, it will be apparent to those skilled in the art that certain variations and modifications may be made without departing from the invention so described. It is intended to include in the invention all such variations and modifications as fall within the scope of the appended claims.

I claim:

1. A billiards table comprising a frame supported on supporting legs, a playing surface supported on the frame, and side and end rails affixed to the playing surface, wherein each rail includes a slot extending substantially the length thereof and provided with a retaining strip adapted to nest snugly in the slot for retaining an edge of felt for the playing surface therein.

2. A billiards table as defined in claim 1 wherein the supporting legs, frame and rails are composed of concrete.

3. A billiards table as defined in claim 2 wherein the playing surface is composed of a mixture of construction grout, portland cement and synthetic fibre strands.

4. A billiards table as defined in claim 3 wherein the playing surface is cast on plexiglass.

5. A billiards table as defined in claim 1 including main levellers comprising coupling nuts secured to the frame and bolts disposed through the coupling nuts supported on the supporting legs.

6. A billiards table as defined in claim 5 wherein the tops of the supporting legs are provided with plates on which the main levellers are supported.

7. A billiards table as defined in claim 6 wherein the plates each include a recess.

8. A billiards table as defined in claim 1 wherein the playing surface is supported on slate levellers attached to the frame.

9. A billiards table as defined in claim 8 wherein each slate leveller comprises a corner bracket secured to the frame having an arm extending parallel to the playing surface, a threaded rod extending through a hole in the arm and embedded in the playing surface, and at least one coupling nut seated on the arm through which the threaded rod is disposed.

10. A billiards table as defined in claim 9 wherein the slate leveller includes a pair of coupling nuts disposed on either side of the arm.

11. A billiards table as defined in claim 9 wherein strips of weather resistant wood extending substantially the length of the playing surface edges are disposed between the playing surface and the arms of the slate levellers, and felt applied to the playing surface is stapled to the wood strips.

12. A billiards table as defined in claim 1 wherein each rail includes two slots, each provided with a retaining strip.

13. The billiards table defined in claim 12 wherien one slot extends along an underside of a top portion of the rail and the strip secures felt covering the playing surface.

14. The billiards table defined in claim 12 wherein one slot extends along a top surface of the rail and the strip secures felt over a playing surface of the rail.

15. A billiards table defined in claim 1 wherein each rail comprises an upper portion extending substantially horizontally and a lower portion extending substantially vertically, a retaining bracket embedded in the rail being provided with a horizontal arm extending through the upper portion away from the playing surface and a vertical arm extending from the horizontal arm partially into the lower portion, and securing means extending through the upper arm and the playing surface and engaged to one arm of a corner bracket, the other arm of which is engaged to the lower portion of the rail.

* * * * *